United States Patent [19]

Leech et al.

[11] 4,367,635

[45] Jan. 11, 1983

[54] COMBINATION CONTROL BOX AND SERVICE CORD STRAIN RELIEF FOR AN AIR CONDITIONING UNIT

[75] Inventors: Brad G. Leech, Fayetteville; Cosimo Caronna, Syracuse, both of N.Y.

[73] Assignee: Carrier Corporation, Syracuse, N.Y.

[21] Appl. No.: 274,013

[22] Filed: Jun. 15, 1981

[51] Int. Cl.[3] ..... F25D 23/12

[52] U.S. Cl. ..... 62/259.1

[58] Field of Search ..... 62/259.1, 531, 262

[56] References Cited

U.S. PATENT DOCUMENTS 3,225,561 12/1965 Hall, Jr. ..... 62/259.1 X
3,286,481 11/1966 Wrench et al. ..... 62/262 X
3,611,743 10/1971 Mangamaro ..... 62/262 X
3,974,661 8/1976 Ferdelman et al. ..... 62/262

*Primary Examiner*—Lloyd L. King
*Attorney, Agent, or Firm*—Robert P. Hayter

[57] ABSTRACT

An air conditioning unit and a control box assembly incorporating as a portion thereof a power cord strain relief are disclosed. A portion of the front panel of the control box is bent into a clip portion parallel to the side panel of the control box. The power cord is mounted therebetween and a screw is utilized to displace the clip portion to secure the power cord between the side panel and the clip portion. An opening in the control box allows the power cord to exit therefrom while secured in position by the components of the control box assembly.

10 Claims, 4 Drawing Figures

COMBINATION CONTROL BOX AND SERVICE CORD STRAIN RELIEF FOR AN AIR CONDITIONING UNIT

BACKGROUND OF THE INVENTION

1. Field of the Invention

The present invention relates to air conditioning units having a power cord extending from the unit to a remote source of power. More particularly, the present invention relates to a control box incorporating a power cord strain relief as a portion thereof for use in an air conditioning unit.

2. Prior Art

Air conditioning units such as the self-contained air conditioning units commonly used for residential and similar applications generally include closed refrigeration circuits having an evaporator and a condenser. The unit is normally divided by a partition into an evaporator section and a condenser section, the evaporator section communicating with room air to be conditioned and the condenser section communicating with external air such as outdoor air. Refrigeration flows through a refrigeration circuit absorbing heat energy from the room air at the evaporator and discharging heat energy to the external air at the condenser. The conventional refrigeration circuit is completed by the addition of a compressor, expansion device and the appropriate connections between the components.

In the evaporator section air is drawn through the evaporator by the evaporator fan and subsequently discharged into the room. In the evaporator the refrigerant changes from a liquid state to a gaseous state absorbing heat energy from the room air being circulated thereover. The gaseous refrigerant from the evaporator is returned to the compressor wherein its pressure and temperature are increased. The evaporator is located in the indoor section and the compressor is located in the outdoor section. From the compressor the hot gaseous refrigerant flows through the condenser wherein it is cooled to change state from a gas to a liquid. Heat energy is discharged to the ambient air being circulated over the condenser by the condenser fan. This liquid refrigerant is then conducted through an expansion device through the partition dividing the unit into the indoor and outdoor sections, back to the indoor coil of the evaporator to complete the refrigeration circuit.

In the conventional room air conditioning unit, the condenser and compressor, being the heat discharging components, are located in that portion of the unit, the outdoor section, wherein heat energy is discharged to ambient air. The evaporator and evaporator fan are located in the indoor section of the unit for absorbing heat energy from the air to be cooled. The fan motor for driving both the condenser fan and evaporator fan is typically located in the outdoor section of the unit.

The typical room air conditioning unit includes a control box portion located in the indoor section in communication with air from the enclosure to be cooled. The control box is located in the indoor section such that a temperature sensing means may sense the temperature of the indoor air and typically, through a bulb arrangement, operate a thermal switch. The control box additionally is formed from metal components forming a closure capable of being certified by an Underwriter's Laboratory and other testing agencies to be used for isolating electrical components as well as mechanical and heat sensing components necessary to control an air conditioning unit. With the control box being located in the indoor section, it is necessary that the wires from the outdoor section pass through various outlets defining portions of the control box to enter the control box. It is additionally necessary that a power cord for use in connecting the air conditioning unit to an external source of a power supply exit from the control box.

In order to eliminate the potential of the power cord being disconnected by a force being applied thereto it is conventional to use a strain relief device which secures the power cord relative to the unit. In the herein application there is disclosed a control box assembly wherein a portion of a front panel of the assembly is bent parallel to a side panel and said portions together act as a service cord or power cord strain relief device.

By bending a portion of the front panel parallel to the side panel and placing the power cord therebetween a screw may thereafter be utilized to clamp the bent portion or clip portion of the front panel to the side panel locking the power cord therebetween. The use of this structure allows the unit to be assembled without incorporating the additional cost and components of a separate strain relief device. Additionally, a device of this type provides strong clamping of the power cord since it is a portion of the control box that is actually performing the clamping function rather than a separate attached device. Additionally, by clamping the power cord in the arrangement described, a structural bond between adjacent sides of the control box is formed increasing the strength thereof. Since an opening is formed in the control box for the service cord to exit therefrom, this same opening may be used for other elements such as a thermostat or capillary tube to exit the control box. Hence, a single opening is provided for serving multiple purposes. Additionally, the present invention discloses a screw in an unobtrusive location for securing the clip portion to hold the service cord. This location allows for ease of assembly and is unobtrusive.

SUMMARY OF THE INVENTION

An object of the present invention is to provide an air conditining unit with a control box incorporating a strain relief device for the service cord.

A further object of the present invention is to provide a control box assembly incorporating a clip portion for securing the service cord between the clip portion and a side panel of the control box.

Another object of the present invention is to provide an easy to assemble and unobtrusive strain relief device for use in an air conditioning unit.

A further object of the present invention is to form a strain relief clip portion from otherwise wasted scrap material.

A further object of the invention is to provide a strong service cord strain relief arrangement.

Another object of the invention is to provide a control box having increased strength and a minimum number of openings extending therethrough.

A further object of the present invention is to provide a safe, economical and reliable apparatus for use with an air conditioning unit.

Other objects will be apparent from the description to follow and the appended claims.

The preceeding objects are achieved according to the preferred embodiment of the invention by the provision of an air conditioning unit having a compressor, an indoor heat exchanger and an outdoor heat exchanger connected to form a refrigeration circuit. Fans are provided for circulating air to be conditioned in heat exchange relation with the indoor heat exchanger and the outdoor heat exchanger. A control box wherein electrical components for the unit may be located has a power cord extending therefrom for connecting the electrical components of the unit to an external power source. The control box includes a portion comprising a cord strain relief device, said power cord passing between a clip portion and a planar surface of the control box and further including a fastening means for securing the clip portion to engage the power cord therebetween. The clip portion is formed by bending a portion of the front panel of the control box into a parallel position with the side panel of the control box. Rounded edges are provided on the clip portion and the side panel to prevent damage to the power cord exiting through the side panel.

DESCRIPTION OF THE PREFERRED EMBODIMENT

The embodiment described below is for use in self-contained room air conditioning unit. It is to be understood that similar control box arrangements for securing the service cord may be provided in other types of self-contained units and other units where there is a necessity for a service cord to exit from a unit and for a strain relief device to be provided for preventing the service cord from being damaged or removed by external forces.

Figure 1:
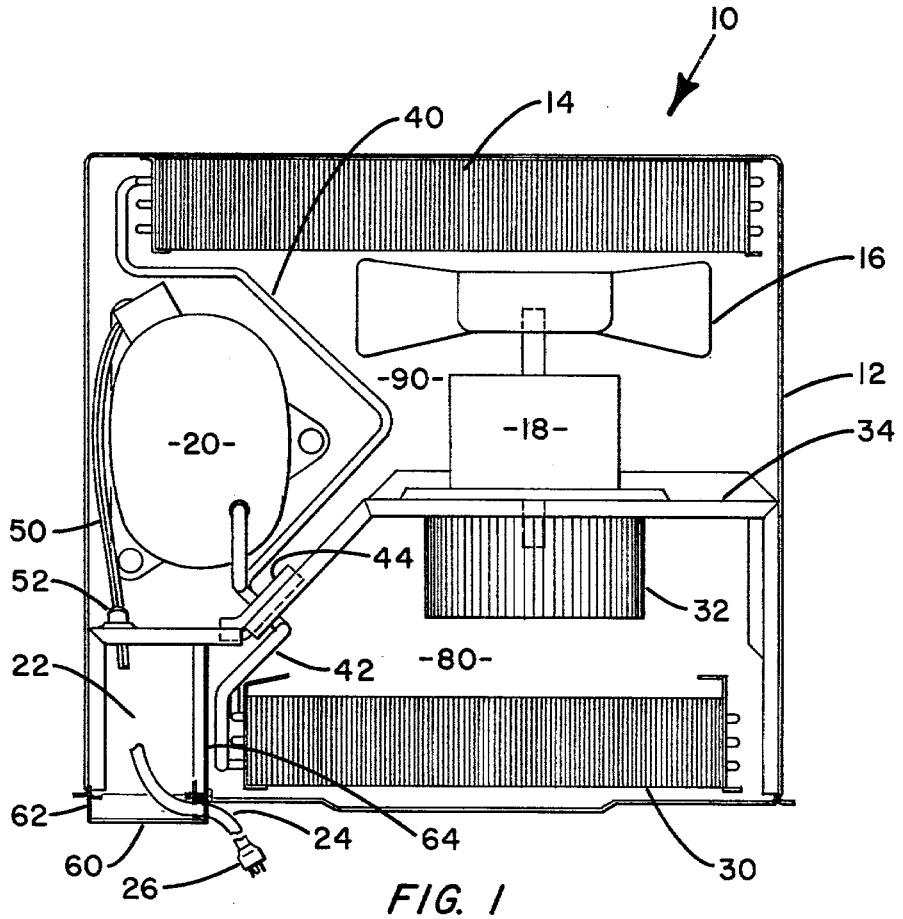
FIG. 1 is a top view of an air conditioning unit.

Referring now to FIG. 1 there can be seen an air conditioning unit 10 having base pan 12 and partition 34 dividing the unit into an indoor section 80 and an outdoor section 90. Within indoor section 80 are evaporator 30, evaporator fan 32 and control box 22. Within outdoor section 90 are located fan motor 18, condenser fan 16, condenser 14 and compressor unit 20. Hence, all the heat generating elements are located in the outdoor section and the evaporator for absorbing heat energy from the indoor air is located in the indoor section. If the unit was described as a heat pump a four-way valve would be included and the function of the heat exchangers would be reversible. A refrigerant line referenced as interconnecting line 40 is shown connecting condenser 14 to evaporator 30. Suction line 42 is shown connecting the evaporator to compressor unit 20. Both lines extend through partition 34 and seal 44. It can also be seen in FIG. 1 that wires 50 from compressor unit 20 extend through wire seal 52 in the partition to control box 22. Additionally, power cord 24 having plug 26 at the end thereof is shown extending from control box 22. Control box 22 is shown having front panel 60, side flange 62 and side panel 64.

Figure 4:
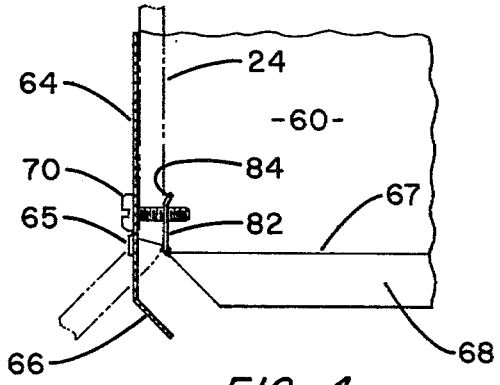
FIG. 4 is a partial sectional view of the side panel and clip portion of FIG. 2 taken in line IV—IV.
Figure 2:
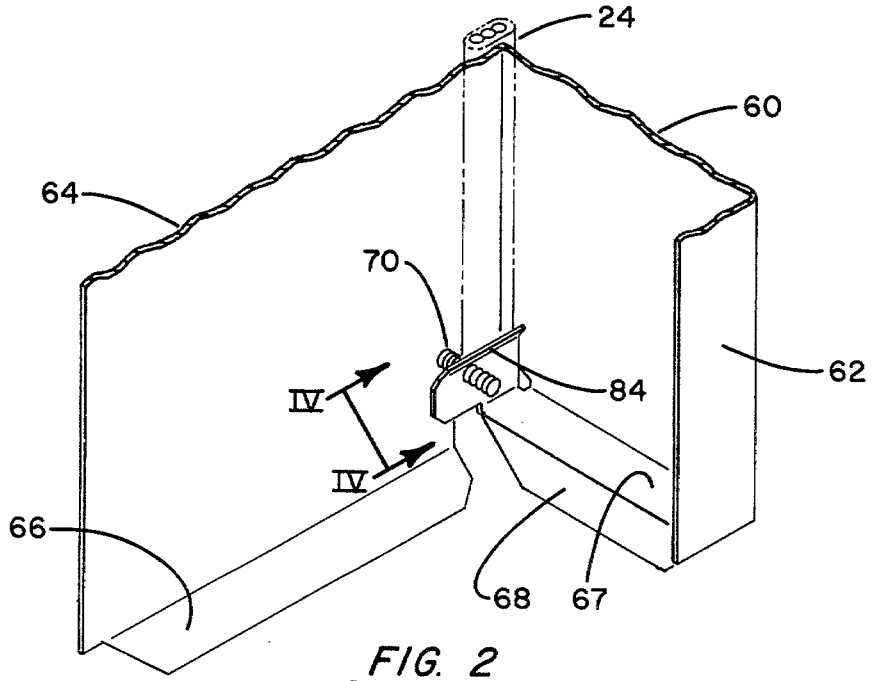
FIG. 2 is an isometric view of a portion of the control box of an air conditioning unit.
Figure 3:
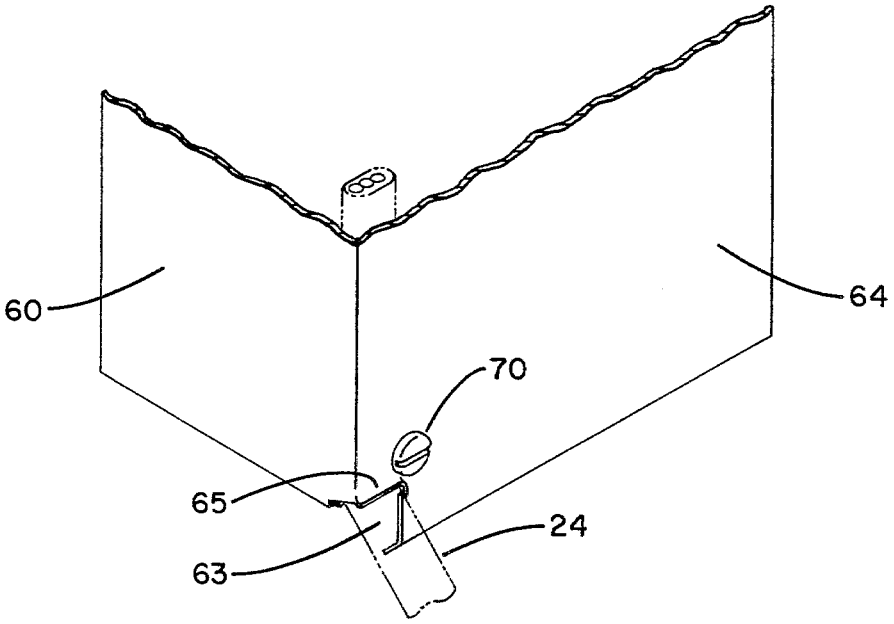
FIG. 3 is an isometric view of the same portion of the control box as shown in FIG. 2, said view being from the opposite direction.

Referring now to FIGS. 2, 3 and 4, it can be seen that the control box is formed from a single piece of sheet metal forming side flange 62, front panel 60, side panel 64, bottom flange 66, ledge 67, extension flange 68 and clip portion 82, including lip 84. This single metal piece when combined with a side wall of the air conditioning unit and partition 34 acts to define a confined chamber having metal walls wherein the electrical components of the unit may be mounted. Within this control box, although not shown, may be mounted such things as thermal sensing devices, relays, electrical contacts, switches, mechanical controls for operating dampers or vents and other similar arrangements. Front panel 60 is located to form a portion of the front of the air conditioning unit and typically has the manually operable control located therein. Extending at right angles to front panel 60 is side panel 64 and side flange 62, one located at each end thereof. Side panel 64 has located at the bottom thereof, bottom flange 66 which extends at an angle from side panel 64. Upon assembly, bottom flange 66 engages base pan 12 to secure the control box in position. Front panel 60 has at the bottom thereof, extending inwardly therefrom, ledge 67. Ledge 67 has extending downwardly therefrom extension flange 68 and mounted at the end of ledge 67 adjacent side panel 64, clip portion 82.

Clip portion 82 is formed by bending a portion of front panel 60 into parallel relation with side panel 64. Lip 84 is then bent at the end of clip portion 82 to provide a curved upper surface. Side panel 64 likewise has a flared portion 65 extending outwardly therefrom at the edge of cord opening 63 to provide a curved surface where power cord 24 contacts same. As may be seen in FIG. 4, lip 84 and flare portion 65 are both curved away from the power cord serving to prevent potential damage to the power cord. Screw 70 is mounted with its head exterior to the side panel and threads extending into an opening in clip portion 82. When the screw is tightened, the clip portion is displaced toward the side panel securing the power cord therebetween.

The assembly of the power cord to the control box is achieved by slipping the power cord into position prior to inserting screw 70. After the power cord is in position, screw 70 is inserted through the side panel into clip portion 82. The screw is then tightened displacing the clip portion to secure the power cord. Screw 70 also serves to secure the front panel and side panels of the control box to each other, increasing the structural integrity of the unit.

The invention herein has been described with reference to a particular embodiment thereof, however, it is to be understood that variations and modifications can be affected within the spirit and scope of the invention.

What is claimed is:

1. An air conditioning unit which comprises a compressor, an indoor heat exchanger and an outdoor heat exchanger connected to form a refrigeration circuit, fan means for circulating air to be conditioned in heat exchange relation with the indoor heat exchanger, a control box wherein electrical components for the unit may be located, a power cord for connecting electrical components of the unit to an external power source and wherein said control box includes a clip portion forming a cord strain relief device, said power cord passing between the clip portion and a planar surface of the control box and further including fastening means for displacing the clip portion to secure the power cord between the clip portion and the planar surface.

2. The apparatus as set forth in claim 1 wherein the control box includes a front panel and a side panel, and wherein the clip portion is formed by bending a portion of the front panel roughly parallel to the plane of the side panel such that the service cord may be restrained between the clip portion and the side panel.

3. The apparatus as set forth in claim 2 and further including the side panel defining a power cord opening through which the power cord may pass, the edge of said opening being partially defined by a flared portion of the side panel, said flared portion being rounded outwardly to reduce the potential for damage to the power cord.

4. The apparatus as set forth in claim 1 wherein the control box includes a front panel defining a portion of the front of the air conditioning unit, a side panel located at right angles to the front panel and extending inwardly therefrom, a side flange extending parallel to the side panel from the opposite end of the front panel, and a bottom flange extending from the side panel for contacting a base pan of the air conditioning unit.

5. The apparatus as set forth in claim 4 wherein the control box further includes a ledge extending from the front panel and an extension flange extending downwardly from the ledge, the clip portion extending upwardly from an end of the edge parallel to the side panel of the control box.

6. A control box assembly for use in an air conditioning unit which comprises a front panel, a side panel extending inwardly from one end of the front panel, and defining a cord opening, a side flange extending from the opposite end of the front panel, a clip portion bent from the front panel to a position roughly parallel to the side panel, a power cord extending through the cord opening and being located between the clip portion and side panel and means for fastening the clip portion to the side panel engaging the power cord therebetween.

7. The apparatus as set forth in claim 6 wherein the front panel further comprises an inwardly extending ledge and wherein the clip portion extends upwardly parallel to the side panel from an end of the ledge.

8. The apparatus as set forth in claim 7 wherein the clip portion further comprises a lip curved therefrom and wherein the side panel further comprises a flared portion curved from the plane of the side panel, both the lip and the flared portion serving to reduce potential for damage to the power cord.

9. The apparatus as set forth in claim 6 wherein the means for fastening comprises a screw inserted through the side panel to engage the clip portion for drawing the clip portion to the side panel securing the power cord therebetween.

10. The apparatus as set forth in claim 8 and further including a ledge extending from the bottom edge of the front panel, said ledge serving to support the control box assembly when mounted.

* * * * *